US006570822B2

(12) United States Patent
Stekelenburg

(10) Patent No.: US 6,570,822 B2
(45) Date of Patent: May 27, 2003

(54) TIME PERIOD SETTING STRUCTURE OF TIMER

(75) Inventor: Albert Stekelenburg, Taipei (TW)

(73) Assignee: All-Time Inc., Taipei (TW)

( * ) Notice: Subject to any disclaimer, the term of this patent is extended or adjusted under 35 U.S.C. 154(b) by 17 days.

(21) Appl. No.: 09/767,729

(22) Filed: Jan. 24, 2001

(65) Prior Publication Data

US 2002/0085454 A1 Jul. 4, 2002

(51) Int. Cl.[7] ..... G04F 8/00; G04F 10/00

(52) U.S. Cl. ..... 368/107; 368/77; 368/185; 368/187

(58) Field of Search ..... 368/77, 89, 107, 368/185, 187, 223, 110, 112, 224, 233, 234, 276, 242, 295

(56) References Cited

U.S. PATENT DOCUMENTS 4,019,037 A * 4/1977 Monna ..... 368/223
4,451,159 A * 5/1984 Tanaka ..... 368/187
4,726,687 A * 2/1988 Gander ..... 368/80
5,572,489 A * 11/1996 Born et al. ..... 368/187
5,933,391 A * 8/1999 Uptegraph ..... 368/187

* cited by examiner

*Primary Examiner*—David Martin
*Assistant Examiner*—Jeanne-Marguerite Goodwin
(74) *Attorney, Agent, or Firm*—Troxell Law Office PLLC

(57) ABSTRACT

A time period setting structure of a timer, in which a rotary disk is provided on a periphery of a setting disk, and a transparent fixing cover and several setting keys are provided in the setting disk. A LCD is also provided in the transparent fixing cover, and a rotary ringed stand is provided under the rotary disk. Several projecting teeth are provided on the outer edge of the ringed body under the ringed stand, and a sliding device is provided on a base, a projecting tooth is provided on the sliding device. When the rotary disk is clockwise/counter-clockwise rotated, to-and-fro movement between left/right and central position is accomplished by the ringed body with projecting teeth fitting with the projecting tooth of the sliding device. Such to-and-fro movement triggers conductor area of pre-set circuit, and the setting of the Hour/Minute can be achieved by operating the rotary disk.

1 Claim, 4 Drawing Sheets

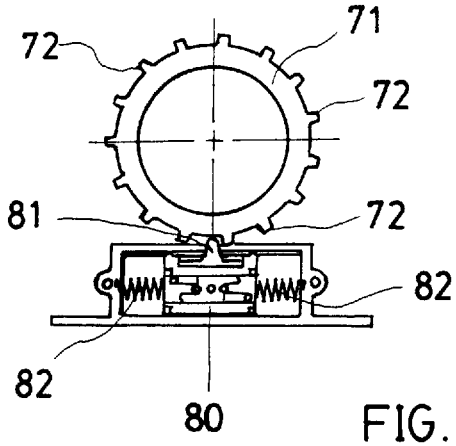
FIG. 4
FIG. 5
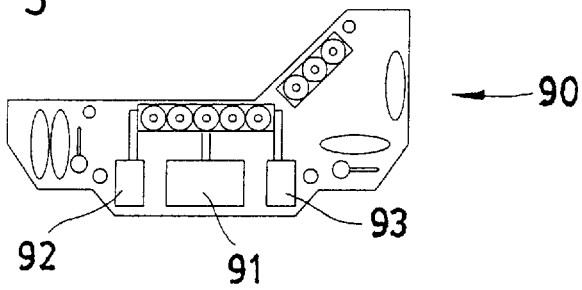
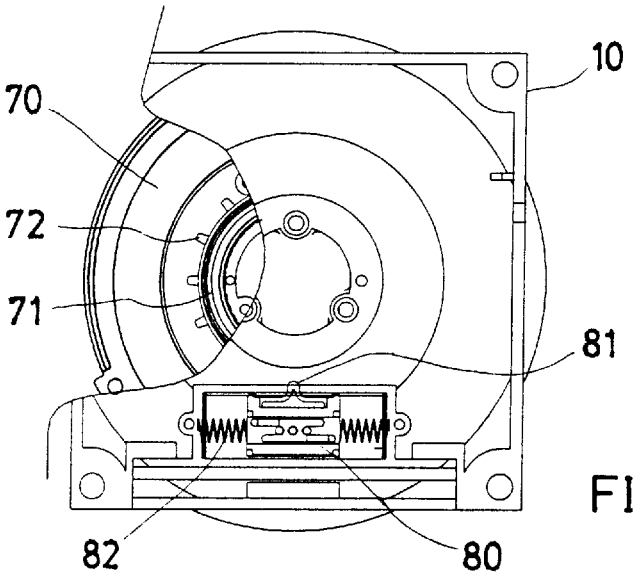
FIG. 6

TIME PERIOD SETTING STRUCTURE OF TIMER

FIELD AND BACKGROUND OF THE INVENTION

The present invention relates to a time period setting device for a timer, with which several pre-set time periods can be set. The present application denotes especially a device for setting "Hour" and "Minute.

There are many setting modes for conventional timers in the market, such as mechanical (setting via striking keyboard is general) and electronic (using key for controlling). There are a variety of timers, including mechanical setting which is an easier setting, but the divisions of each time period is larger. In other words, one can only make a coarse setting of the time period. For electronic setting, the usable space on the setting disk is not large, because there are many keys therein. Thus, one who does not know the operation well, or whose fingers are large, easily makes an erroneous setting, and it's more difficult in operation. The present application is an electronic timer, for smaller numeral changes, such as setting ON/OFF, setting switching timing/present time, "week X" ext, which are controlled by the keys, and for two larger numeral changes, such as "Hour X" and "Minute X", which are set by means of rotating a rotary disk.

SUMMARY OF THE INVENTION

The object of the present application is to provide a device for setting the time period; it general operating condition as are noted below:

1. function: setting time ON/OFF for several groups; timing 1–7 days.
2. Program mode: divided into displaying present time (clock) and setting time period.
3. Function of the keys:

a. Clock mode-displaying present time mode, (a-1) key "ON/OFF": switching ON/OFF output, (a-2) key "Clock +Day": regulating present week (MO–SU), (a-3) key "Clock" +rotary disk rotated clockwise: regulating "Hour" for present time, (a-4) key "Clock" +rotary disk rotated counter clockwise: regulating "Minute" for present time, (a-5) key "Timer": entering into program mode.

Under clock mode, key "Day" and rotary disk are clock wise/counter clockwise rotated, alone use will be without function, the function to be produced must match key "Clock", b. program mode: setting time mode, (b-1) key "ON/OFF": without function, (b-2) key "Day": regulating day (of week) of timer ON/OFF. there are 11 settings for date, such as MO, TU, WE, TH, FR, ST, SU, MO-FR, SA-SU, MO-SA, MO-SU, (b-3) rotary disk rotated clockwise: setting time "Hour" of timing function, (b-4) rotary disk rotated clockwise: setting time "Minute" of timing function, (b-5) key "Timer": ON/OFF time setting switching (1 ON→1 OFF→2 ON→ . . . →6 OFF) of 6 groups ON/OFF for timing function, (b-6) key "Clock": returning clock mode, c. key "Reset": all memories are cancelled when the key "Reset" is depressed whether it is under clock or program mode, and the program is again started.

As above-mentioned, the characteristics of the present application are to provide a structure setting "Hour X" and "Minute X", in which setting the Hour/Minute is operated by clockwise or counter-clockwise rotation, without the necessity for setting many keys on a dial, such that the erroneous position produced at the time setting "Hour" and "Minute" can be avoided.

The technical solution of the present application is that, a rotary disk is provided in the outer edge, with a ringed structure having several projecting teeth driven by rotating the rotary disk, and a sliding structure which can be moved to right/left by stirring the projecting tooth. A circuit contact structure is provided on the sliding structure, whereby the Hour/Minute can be quickly set by means of a contact (producing pulse) time on the special area of the circuit board for the structure.

The circuit part of timer in the present application will not be described since it belongs to a conventional technical field.

BRIEF DESCRIPTION OF THE DRAWINGS

FIG. 4 is a schematic view illustrating mating positions of a rotary ringed stand and a sliding device;

FIG. 5 is a schematic view of a second circuit board;

FIG. 6 is a schematic view of the sliding device under normal position;

DETAILED DESCRIPTION OF THE PREFERRED EMBODIMENT

Figure 1:
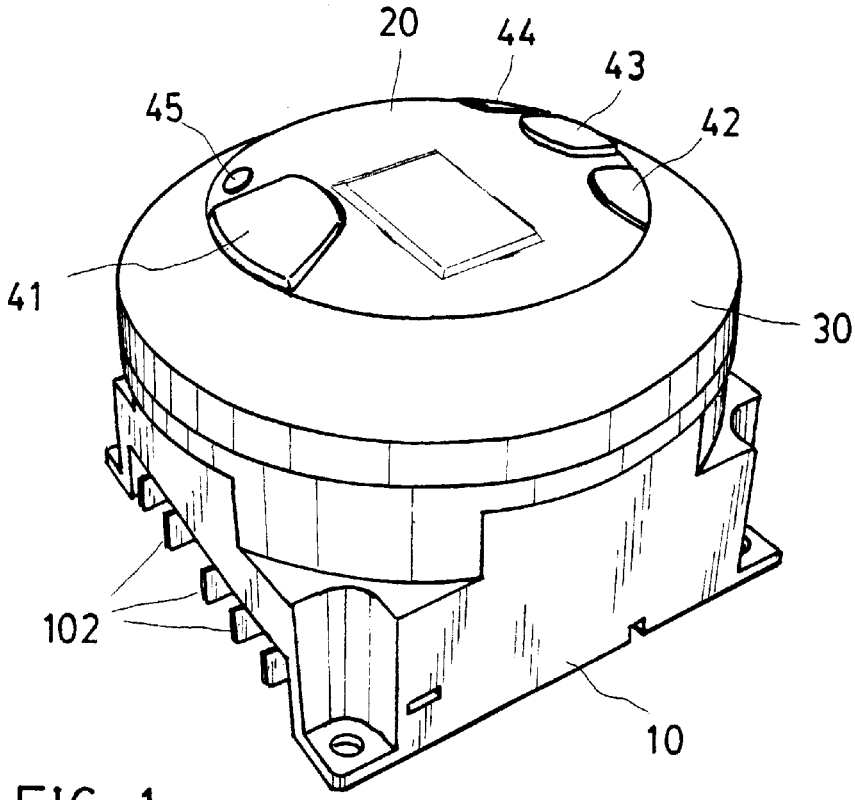
FIG. 1 is a perspective view of the present invention.

As shown in FIG. 1, there is a transparent fixing cover 20 on a housing 10, and there is a rotary disk 30 on a circumference of the fixing cover 20. Several keys 41, 42, 43, 44, 45 are provided on the fixing cover 20.

Figure 2:
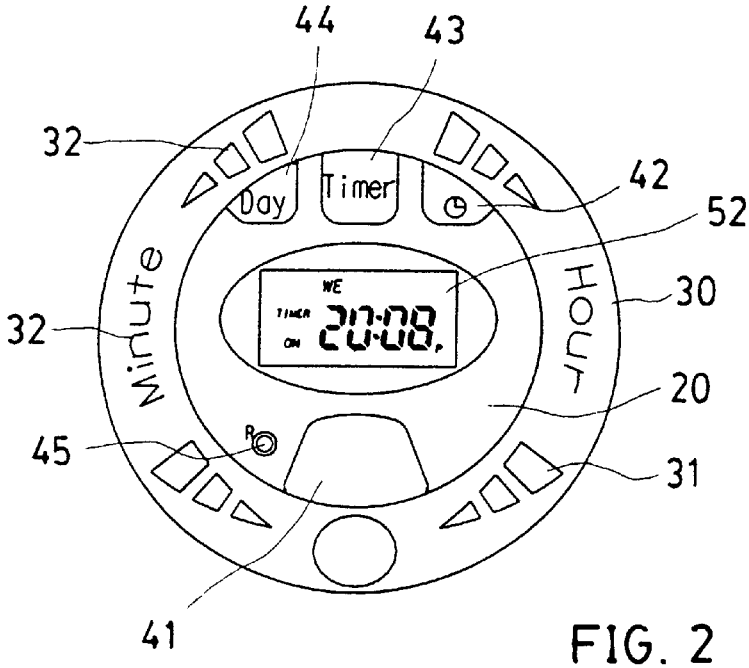
FIG. 2 is a top view of the present invention.

As shown in FIG. 2, displays on the LCD displaying board 52 can be seen by the eye from the transparent fixing cover 20. Marks 31, 32 are printed on the rotary disk 30, in order to inform to user of the rotating direction and its function;

wherein key 41 is key "ON/OFF";

key 42 is key "Clock";

key 43 is key "Timer";

key 44 is key "Day";

key 45 is key "Reset".

Increasing the "Hour" can be controlled when the rotary disk 30 is clockwise rotated, and increasing the "Minute" can be controlled when the rotary disk 30 is counter-clockwise rotated, all of which must be mated with key 42.

Figure 3:
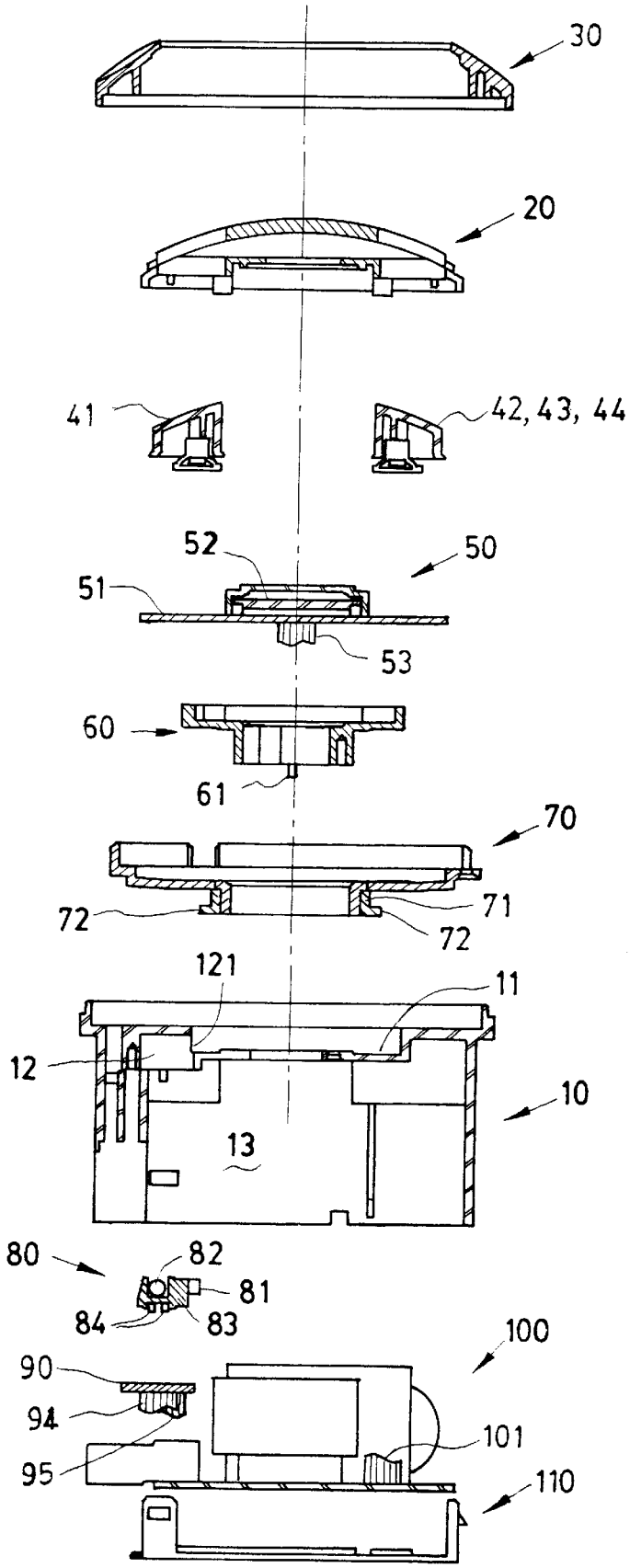
FIG. 3 is an exploded view of elements of the present invention.

As shown in FIG. 3, the structure of the present application includes also a first circuit board 50, a receiving stand 60, a rotary ringed stand 70, a sliding device 80, a second circuit board 90, a third circuit board 100 and a base 110, except that which contains a housing 10, a fixing cover 20, a rotary disk 30 and keys 41, 42, 43, 44, 45.

The receiving stand 60 above housing 10 is fixed by inserted pin 61, the rotary ringed stand 70 above housing 10 is provided in the ringed recess 11, the sliding device 80 in one side of the housing is provided in sliding recess 12, the second circuit board 90 and the third circuit board 100 are provided in the space 13, under the housing 10 is connected with base 110.

The fixing cover 20 is a structural body of transparent material, which has respective through holes provided for each 41, 42, 43, 44, 43. Under fixing cover 20 is connected the first circuit board 50.

The first circuit board 50 is a conventional device, the LCD displaying board 52 is provided on the circuit board 51, in order to display the present time or a setting time period. The receiving stand 60 is downwards connected with first circuit board 50, and is upwards connected with fixing cover 20, and the bus 53 of circuit board 50 is connected with second circuit board 90.

The under side of receiving stand 60 passes through the inner side of the rotary ringed stand 70, which is provided on the housing 10 by inserted pin 61 or screw.

The rotary disk 30 and the rotary ringed stand 70 are integrated by clip or screw etc., both receiving the above-mentioned fixing cover 20, keys 41, 42, 43, 44, 45, first circuit board 50 and receiving stand 60, etc. The rotary ringed stand 70 is provided in the recess 11, several projecting teeth are provided on the ringed body 71 under the rotary ringed stand 70.

A sliding recess 12 is provided on the housing 10, in order to accommodate sliding device 80, wherein the projecting tooth 81 of sliding device 80 projects from side opening 121 of sliding recess 12, and the projecting teeth 72 of rotary ringed stand 709 are mated with the projecting tooth 81 of sliding device 80, in order to use for setting the "Hour" and the "Minute".

As shown in FIG. 4, the projecting teeth 72 make the projecting tooth 81 move leftwards when the ringed body 71 is clockwise rotated, the sliding device 80 slides back to a central position, due to the restoring force of spring 82 when the projecting teeth 72 are apart from the projecting tooth 81. The next projecting tooth 72 will be again in contact, which makes the projecting tooth 81 again move leftwards, if the ringed body 71 is continuously clockwise rotated (please reference to FIG. 7).

As above-mentioned, the projecting teeth 72 makes the projecting tooth 81 move rightwards, when the ringed body 71 is counter-clockwise rotated. The device 80 slides back to a central position due to the restoring force of spring 82, when the projecting teeth 72 are apart from the projecting tooth 81. The next projecting tooth 72 will be again in contact, which makes the projecting tooth 81 move again rightwards, if the ringed body 71 is continuously counter clockwise rotated (please reference to FIG. 8).

In other words, clockwise/counter clockwise rotating of the rotary disk will make the sliding device 80 move from the central to left/right as to-and-fro movement.

In FIG. 4, the sliding device 80 is provided in a tangential position of ringed body 71, it constitution includes a contact device 84 provided under the housing 83, which is used for conducting with the conductor area of second circuit board 90.

As shown in FIG. 5, which is a schematic view of second circuit board 90, wherein three conductor areas 91, 92, 93 are provided thereon, the position of the contact device 84 when not moved leftward or rightward, is between three conductor areas 91, 92, 93, i.e., three conductor areas 91, 92, 93 and the contact device 84 are in conducting positions. For "increasing Hour", the contact device 84 is leftwards moved, the conductor device 84 is rightwards moved. Utilizing the above-mentioned leftward/rightward movement conducts respectively different conductor areas, which makes circuit increasing setting number of Hour/Minute, which is produced due to the conducting time.

Figure 7:
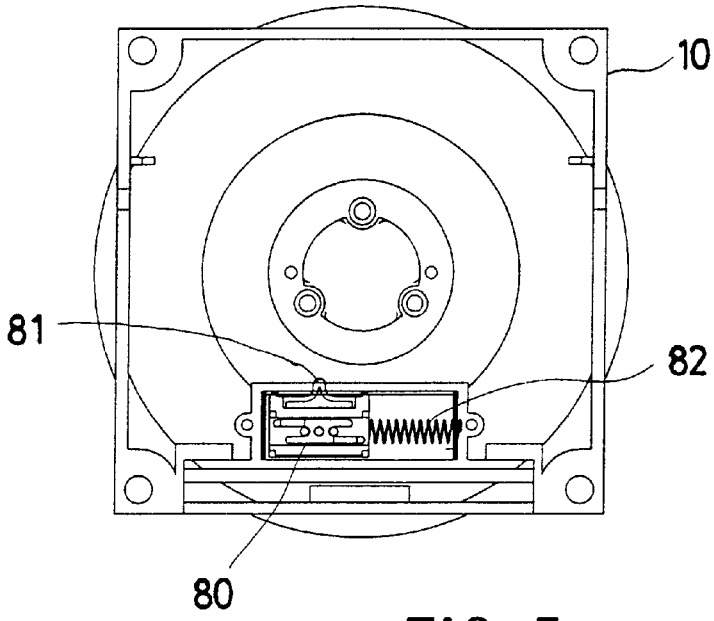
FIG. 7 is a schematic view of the sliding device in a first position.
Figure 8:
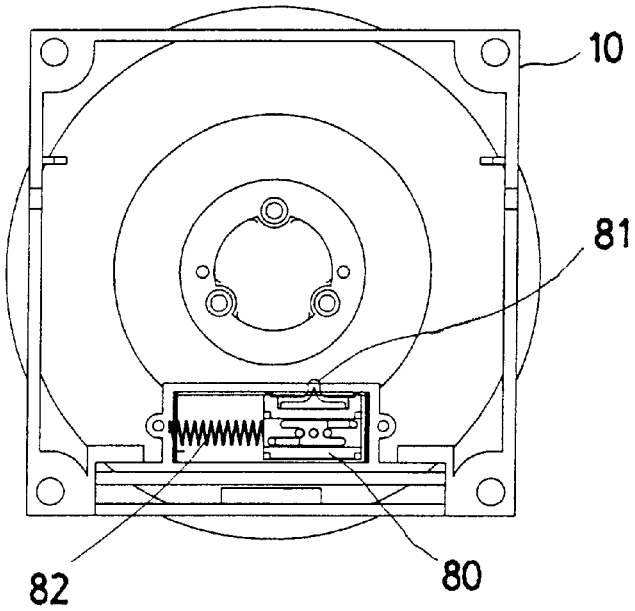
FIG. 8 is a schematic view of the sliding device in a second position.

As shown in FIG. 6, the sliding device 80 is a normal position (without increasing "Hour", without increasing "Minute"). As shown in FIG. 7, the sliding device 80 is a left position, for increasing the Hour. As shown in FIG. 8, the sliding device 80 is in right position, for increasing the Minute.

The third circuit board 100 in FIG. 3 is via bus 101 connected with bus 94 of the second circuit board 90 (bus 94, 101 are the same bus), bus 95 and bus 53 are the same bus, several connectors 102 are provided on the third circuit board 101 which conduct respectively input circuit and output circuit.

In summary, the timer of present application can make the circuit functional, for setting "Hour/Minute", by means of controlling the rotary disk provided in the outer edge of the dial, which is clockwise/counter clockwise rotated and its function can be further displayed on LCD displaying board 52, enabling the setting position to be seen by eye.

What is claimed is:

1. A time period setting structure, comprising:

a setting disk including a transparent fixing cover and a plurality of keys extending through the transparent cover, a rotary disk at a periphery of the transparent cover, a LCD under the transparent cover, the plurality of keys including an "ON/OFF" key, a "Clock" key, a "Timer" key, a "Day" key and a "Reset" key; a first circuit board provided under the setting disk, the LCD provided on the first circuit board;

the rotary disk provided in an outer edge of the setting disk, and connected with a rotary ringed stand thereunder;

a housing receiving the rotary ringed stand therein, the rotary ringed stand including a ringed body with plurality of projecting teeth; a sliding device provided in a sliding recess located in one side of the housing; second and third circuit boards provided in the housing, the sliding device provided in tangential position with the ringed body, and including a projecting tooth and spring bringing the sliding device to a central position, the projecting tooth mating with the projecting teeth of the ringed body, such that the sliding device produces transverse to-and-fro movement when the ringed body is rotated by rotation of the rotary disk; a contact device is provided on the sliding device;

the second circuit board includes three conductor areas thereon, whereby, as the sliding device is moved to-and-fro by engagement between the projecting teeth of ringed stand and the projecting tooth of the sliding device, when the setting disk is rotated clockwise/counter clockwise contact between the sliding device and the three conductor areas of the second circuit board changes setting of hours and minutes.

* * * * *